US012467245B2

(12) United States Patent
Yang

(10) Patent No.: US 12,467,245 B2
(45) Date of Patent: Nov. 11, 2025

(54) WATER BLOCKING MEMBER

(71) Applicant: Huijie Yang, Guangdong (CN)

(72) Inventor: Huijie Yang, Guangdong (CN)

( * ) Notice: Subject to any disclaimer, the term of this patent is extended or adjusted under 35 U.S.C. 154(b) by 0 days.

(21) Appl. No.: 18/583,196

(22) Filed: Feb. 21, 2024

(65) Prior Publication Data

US 2025/0084625 A1 Mar. 13, 2025

(30) Foreign Application Priority Data

Sep. 13, 2023 (CN) ..... 202322486595.3
Jan. 31, 2024 (CN) ..... 202420242310.3

(51) Int. Cl.
*E03C 1/181* (2019.01)
*E03C 1/04* (2006.01)

(52) U.S. Cl.
CPC ..... *E03C 1/181* (2013.01); *E03C 1/04* (2013.01)

(58) Field of Classification Search
CPC ..... E03C 1/181; E03C 1/04; A47K 3/001; A47K 3/302; A47K 2003/305; A47J 47/20
USPC ..... 4/658
See application file for complete search history.

(56) References Cited

U.S. PATENT DOCUMENTS 3,444,564 A * 5/1969 Lavacchia ..... A47K 3/004 4/559
5,365,619 A * 11/1994 Solomon ..... A47K 3/30 4/609
6,857,140 B1 * 2/2005 Broudy ..... A47K 3/38 4/558
2017/0209004 A1 * 7/2017 Jackson ..... A47K 3/001

* cited by examiner

*Primary Examiner* — Lauren A Crane
(74) *Attorney, Agent, or Firm* — Westbridge IP LLC

(57) ABSTRACT

A water blocking member includes a fixed plate, a water baffle plate and a locking device. The fixed plate is rotatably connected to the water baffle plate. The water baffle plate and the fixed plate are locked and fixed through the locking device, and the locking devices configured to lock an angle between the water baffle plate and the fixed plate. Through the above structure, a user can fixedly place the fixed plate in a sink or a bathtub or any other position platform that requires water blocking. Under the locking action of the locking device, the water baffle plate is rotated to a locking position relative to the fixed plate. The water baffle plate is locked in a basically perpendicular state relative to the fixed plate.

19 Claims, 9 Drawing Sheets

WATER BLOCKING MEMBER

CROSS-REFERENCE TO RELATED APPLICATIONS

The application claims priority of Chinese patent application CN2023224865953, filed on Sep. 13, 2023, which is incorporated herein by reference in its entireties. The application claims priority of Chinese patent application CN2024202423103, filed on Jan. 31, 2024, which is incorporated herein by reference in its entireties.

TECHNICAL FIELD

The present disclosure relates to the technical field of water blocking, and in particular, to a water blocking member.

BACKGROUND

Sinks and bathtubs play important roles at home. They are not only for daily cleaning, but also helpful for the overall functionality and aesthetics of kitchens and bathrooms. Traditional sinks and bathtubs, whether located in the kitchens or bathrooms, are mostly made of materials such as stainless steel, iron enamel, or ceramic.

However, a common problem is that these sinks and bathtubs do not have effective water blocking devices. When people clean tableware and food, or take a shower in the bathtub, high water flow impact may cause water to splash out. If the splashing water is higher than an edge of the container, the splashing water will splash outside or may wet the clothes of a user. In the kitchen, the splashing water can make the kitchen greasier, which increases the difficulty of cleaning. In the bathroom, the splashing water may make the floor slippery, which increases the risk of slipping.

SUMMARY

In order to overcome the shortcomings in the prior art, the present disclosure provides a water blocking member, which can effectively block splashing water and is conveniently carried and stored by a user.

The technical solution adopted by the present disclosure to solve the technical problem is as follows.

The present disclosure provides a water blocking member, including:

a fixed plate;

a water baffle plate, wherein the fixed plate is rotatably connected to the water baffle plate; and a locking device, wherein the water baffle plate and the fixed plate are locked and fixed through the locking device, and the locking device is configured to lock an angle between the water baffle plate and the fixed plate.

As the improvement of the present disclosure, the locking device is a strap locking device, a hook and loop fastener locking device, a snap ring locking device, an elastic band locking device, or a suction locking device.

As the improvement of the present disclosure, the suction locking device includes a magnetic suction locking device or a suction cup locking device.

As the improvement of the present disclosure, the locking device includes a first connector and a second connector; the first connector is arranged on the water baffle plate; the second connector is arranged on the fixed plate; and the first connector is connected to the second connector to lock and fix the fixed plate with the water baffle plate.

As the improvement of the present disclosure, the first connector is detachably connected to the second connector.

As the improvement of the present disclosure, the first connector includes at least one snap-in member; an outer surface of the water baffle plate protrudes out to form the snap-in member; the second connector includes at least one clamping member; and an outer surface of the fixed plate protrudes out to form the clamping member configured to clamp and fix the snap-in member.

As the improvement of the present disclosure, there are three snap-in members and three clamping member.

As the improvement of the present disclosure, each clamping snap-in is composed of one or more first reinforcing ribs; one ends of the first reinforcing ribs extend inwards until the ends are connected and combined to form a snap-in part; each clamping member is composed of one or more second reinforcing ribs; one ends of the second reinforcing ribs extend inwards to form a clamping groove; and the snap-in parts are all inserted into the clamping grooves and are pressed and clamped inwards by the clamping grooves to be fixed.

As the improvement of the present disclosure, the water blocking member further includes side baffle plates, wherein the side baffle plates are inserted into two ends of the fixed plate.

As the improvement of the present disclosure, bottom surfaces of the side baffle plates protrude out to form bases; one side surface of each side baffle plate is provided with a connecting seat; the connecting seats and the bases are integrally connected; bottom surfaces of the bases are provided with insertion grooves; connecting grooves are formed in opposite surfaces of the connecting seats; the side baffle plates are arranged on two sides of the fixed plate; the two sides of the fixed plate protrude out to form insertion parts; lower parts of the side baffle plates sleeve the insertion parts through the insertion grooves; one sides of the side baffle plates sleeve two ends of the water baffle plate through the connecting grooves; and the water baffle plate and the side baffle plates are combined to form a water blocking region of a "U"-shaped structure.

As the improvement of the present disclosure, the first connector includes at least one lock catch, and the second connector at least includes one locking member; each lock catch is provided with a through hole; and the locking member passes through the through hole and is compressed and locked to the lock catch.

As the improvement of the present disclosure, there are three lock catches and three locking members.

As the improvement of the present disclosure, the locking member is provided with at least one stop buckle; the locking member and the stop buckle pass through the through hole by compression; and when each stop buckle is pressed into the through hole and is completely separated from the through hole, the stop buckle returns to an original state and resists against the lock catch to lock and fix the fixed plate with the water baffle plate.

As the improvement of the present disclosure, the lock catch is composed of a bulge arranged on the fixed plate; the locking member includes a third reinforcing rib arranged on the water baffle plate and a locking strip fixedly connected to the third reinforcing rib; and a maximum width of the locking strip is slightly greater than a diameter of the through hole, so that when passing through the through hole, the locking strip is locked and fixed with the bulge under the pressing action.

As the improvement of the present disclosure, the stop buckle is composed of a retaining block arranged on an outer wall of the locking strip in a surrounding manner; and a minimum width of the retaining block is greater than a diameter of the through hole.

As the improvement of the present disclosure, an elastic connecting section is arranged between the water baffle plate and the fixed plate, and the elastic connecting section is configured to elastically connect the water baffle plate to the fixed plate.

As the improvement of the present disclosure, one end of the fixed plate away from the water baffle plate is bent downwards to form a limiting part.

As the improvement of the present disclosure, a bottom of the fixed plate is connected to a fastening device, and the fixed plate is configured to be fixedly connected to a water trough surface through the fastening device.

As the improvement of the present disclosure, the fastening device includes at least one suction cup mounted on a bottom surface of the fixed plate.

As the improvement of the present disclosure, the fastening device includes at least one column of several suction cups uniformly mounted at the bottom of the fixed plate.

As the improvement of the present disclosure, the fixed plate and the water baffle plate are at least partially made of a flexible material.

As the improvement of the present disclosure, at least one of the lock catch and the locking member is a flexible material component.

The present disclosure has the following beneficial effects. The present disclosure provides a water blocking member. The water blocking member includes a fixed plate; a water baffle plate, wherein the fixed plate is rotatably connected to the water baffle plate; and a locking device, wherein the water baffle plate and the fixed plate are locked and fixed through the locking device, and the locking devices configured to lock an angle between the water baffle plate and the fixed plate. Through the above structure, a user can fixedly place the fixed plate in a sink or a bathtub or any other position platform that requires water blocking. Under the locking action of the locking device, the water baffle plate is rotated to a locking position relative to the fixed plate. In this case, the water baffle plate is locked in a basically perpendicular state relative to the fixed plate. The supported water baffle plate effectively plays a role in preventing water flow in the sink or the bathtub from splashing, which greatly reduces water splashing and is conductive to keeping a surrounding environment dry and clean.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

First Embodiment

Figure 1:
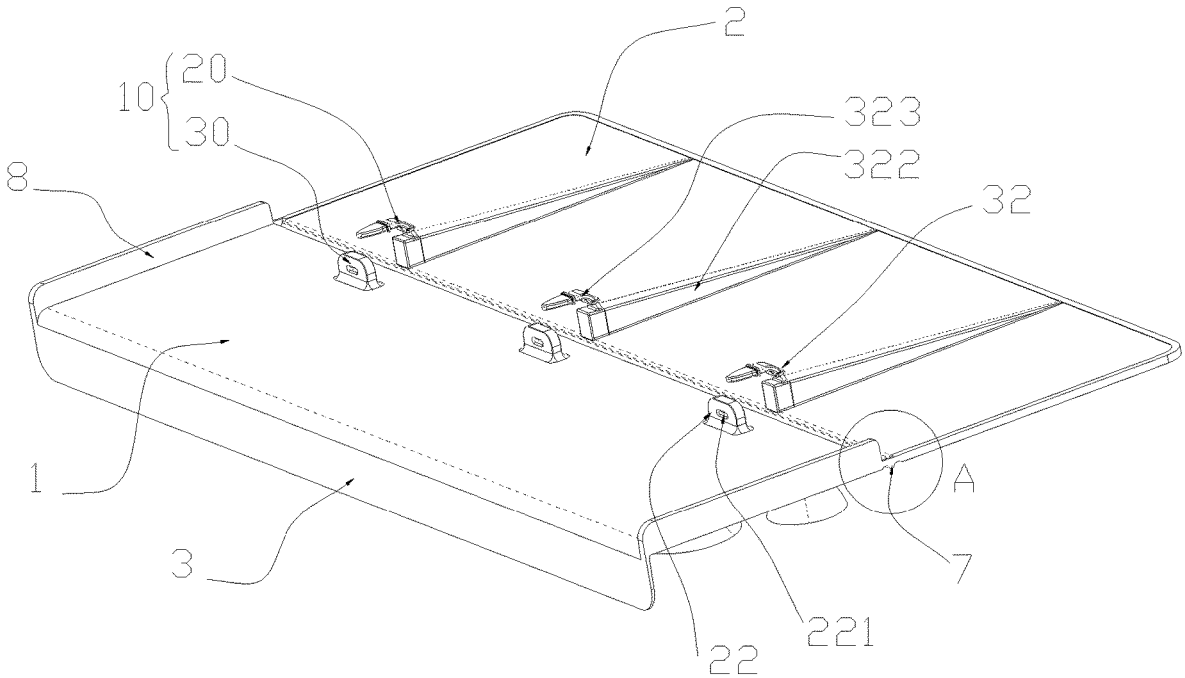
FIG. 1 is a schematic diagram of an entire structure according to a first embodiment of the present disclosure.
Figure 2:
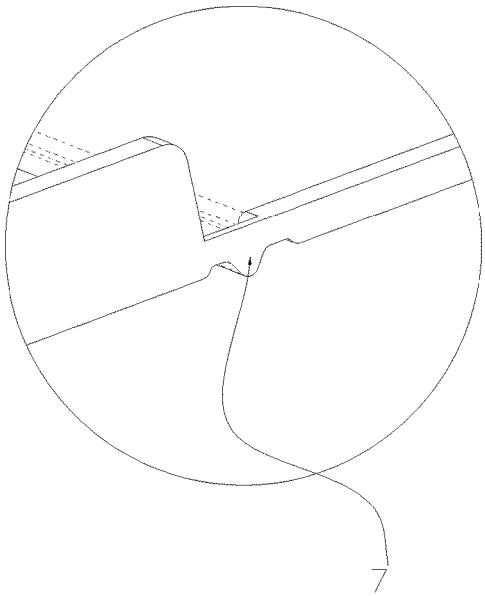
FIG. 2 is an enlarged diagram of part A in FIG. 1.
Figure 3:
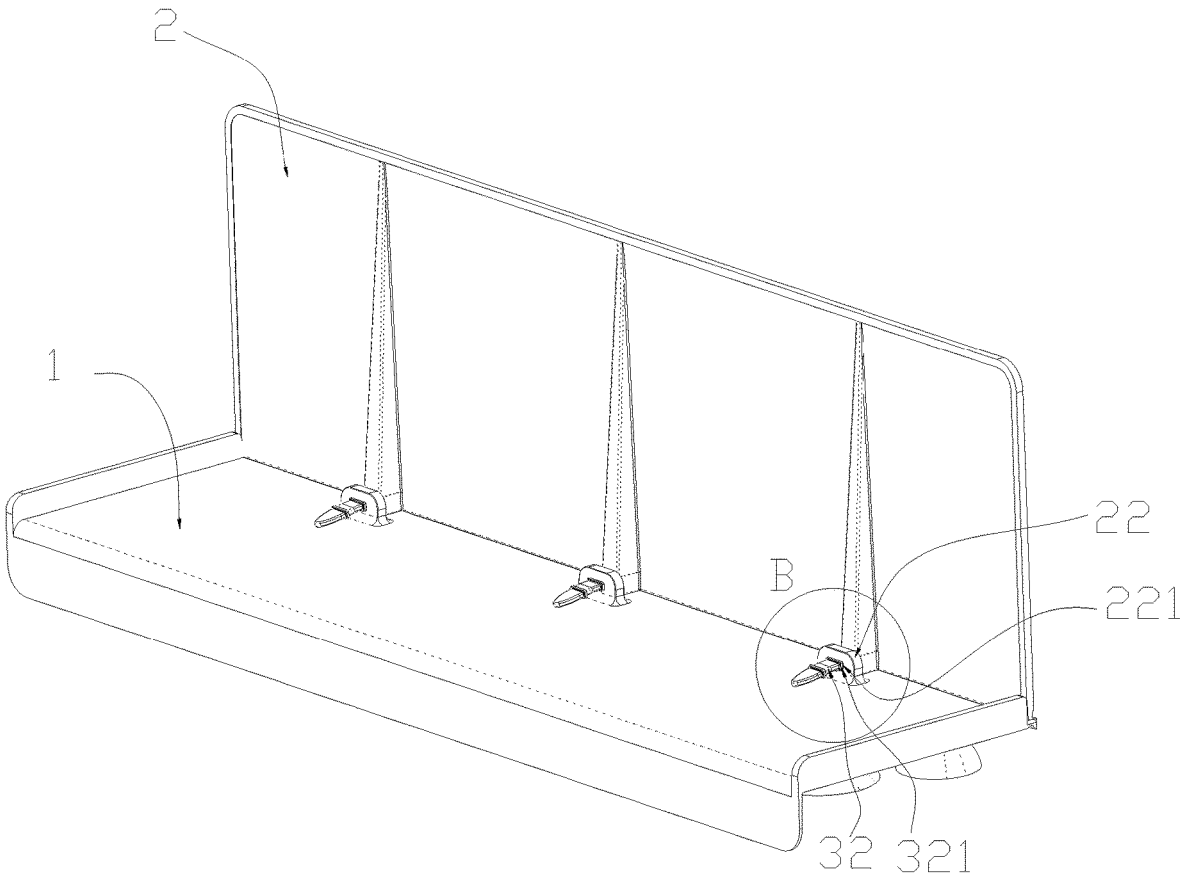
FIG. 3 is a schematic diagram of a usage state according to a first embodiment of the present disclosure.
Figure 4:
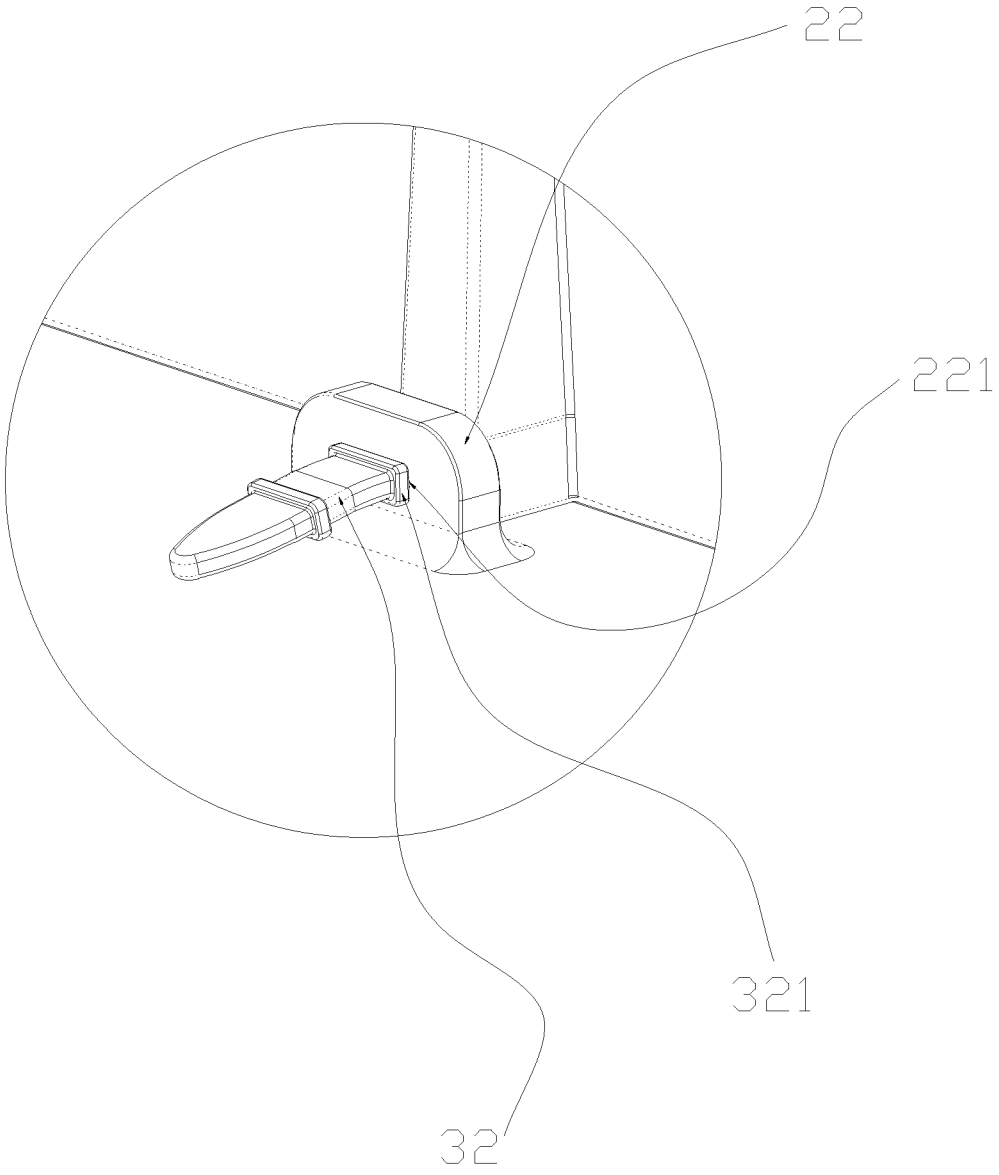
FIG. 4 is an enlarged diagram of part B in FIG. 3.
Figure 5:
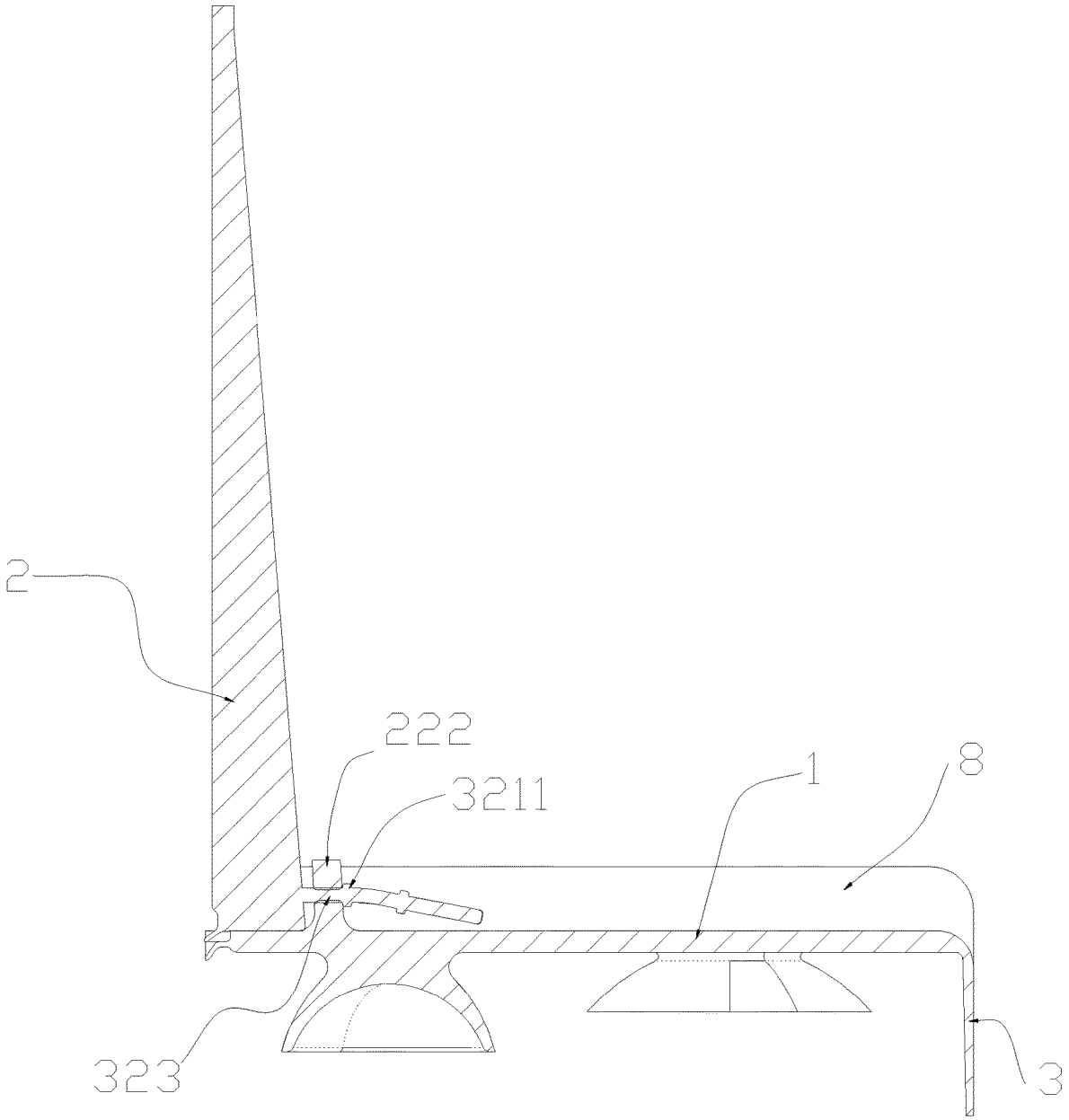
FIG. 5 is a cross-sectional diagram of a usage state according to a first embodiment.
Figure 6:
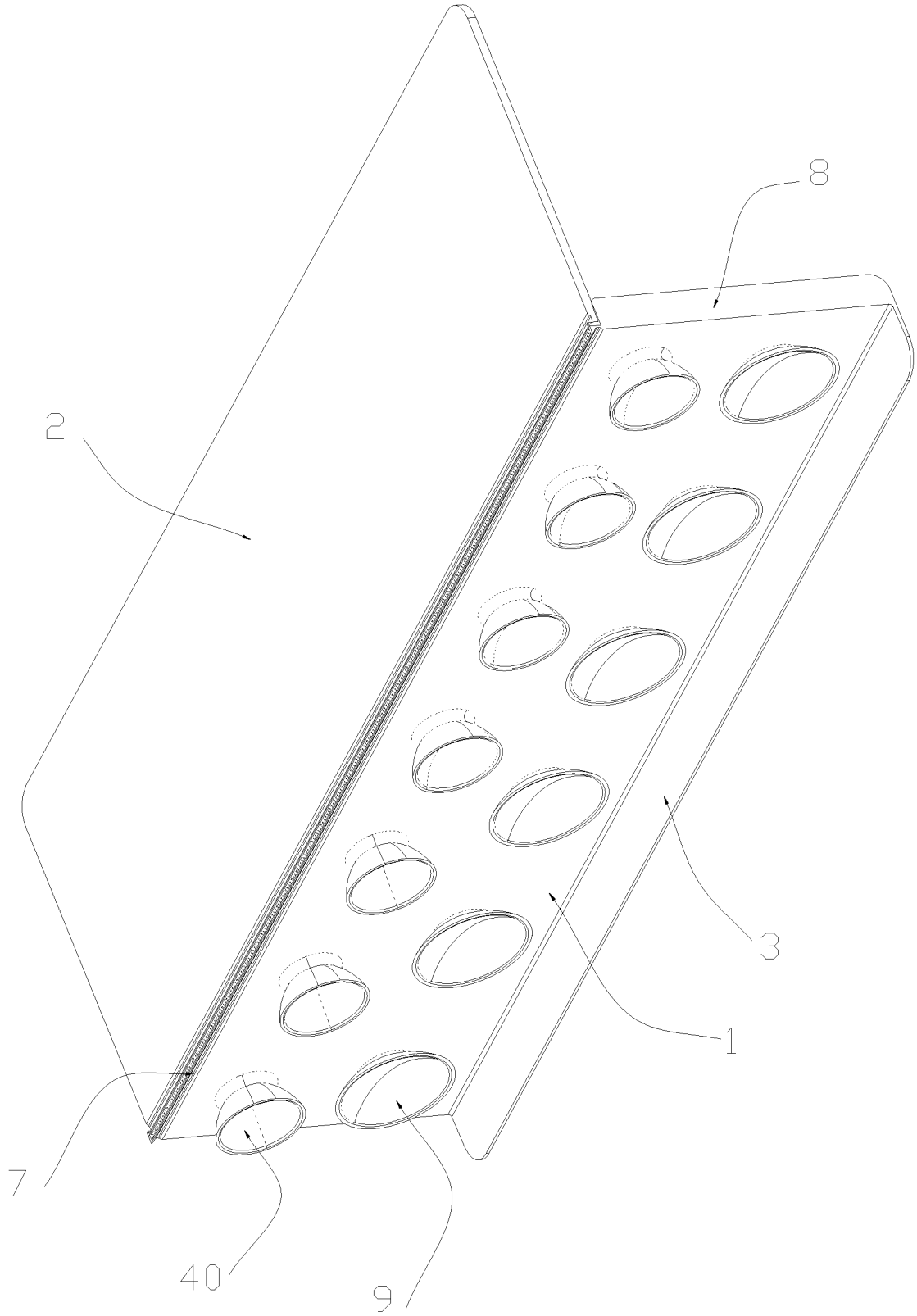
FIG. 6 is a bottom view of a usage state according to a second embodiment.

As shown in FIG. 1 and FIG. 6, a water blocking member includes a fixed plate 1; a water baffle plate 2, wherein the fixed plate 1 is rotatably connected to the water baffle plate 2; and a locking device 10, wherein the water baffle plate 2 and the fixed plate 1 are locked and fixed through the locking device 10, and the locking device 10 is configured to lock an angle between the water baffle plate 2 and the fixed plate 1. Further, the locking device can be a strap locking device, a hook and loop fastener locking device, a snap ring locking device, an elastic band locking device, a magnetic suction locking device, or a suction locking device. Through the above structure, a user can fixedly place the fixed plate 1 in a sink or a bathtub or any other position platform that requires water blocking. Under the locking action of the locking device 10, the water baffle plate 2 is rotated to a locking position relative to the fixed plate 1. In this case, the water baffle plate 2 is locked in a basically perpendicular state relative to the fixed plate 1. The supported water baffle plate 2 effectively plays a role in preventing water flow in the sink or the bathtub from splashing, which greatly reduces water splashing and is conductive to keeping a surrounding environment dry and clean.

In this embodiment, the locking device 10 includes a first connector 20 and a second connector 30; the first connector 20 is arranged on the water baffle plate 2; the second connector 30 is arranged on the fixed plate 1; and the first connector 20 is connected to the second connector 30 to lock and fix the fixed plate 1 with the water baffle plate 2. Further, the second connector 20 is detachably connected to the second connector 30. Through the connectors separately arranged on the fixed plate 1 and the water baffle plate 2, the connection and locking of the fixed plate 1 and the water baffle plate 2 can be achieved through the connection and fixation of the two connectors. Furthermore, the connectors are detachably connected, so that it is convenient for the user to separate, store, and arrange the connectors after the user finishes using the water blocking member; the water blocking member is convenient to carry; and the storage space is reduced.

In this embodiment, the first connector 20 includes at least one lock catch 22, and the second connector 30 at least includes one locking member 32; each lock catch 22 is provided with a through hole 221; and the locking member 32 passes through the through hole 221 and is compressed and locked to the lock catch 22. Specifically, there are three lock catches 22 and three locking members 32.

Further, the lock catch 22 is composed of a bulge 222 arranged on the fixed plate 1; the locking member 32 includes a third reinforcing rib 322 arranged on the water baffle plate 2 and a locking strip 323 fixedly connected to the third reinforcing rib 322; and a maximum width of the locking strip 323 is slightly greater than a diameter of the through hole 221, so that when passing through the through hole 221, the locking strip 323 is locked and fixed with the bulge 222 under the pressing action. Through the above structure, when the maximum width of the locking strip 323 is slightly greater than the diameter of the through hole 221, it is convenient for the locking strip 323 to penetrate into the through hole 221 and achieve the pressing and locking effect.

In this implementation, each locking member 32 is provided with at least one stop buckle 321; the locking member 32 and the stop buckle 321 pass through the through hole 221 by compression; and when each stop buckle 321 is pressed into the through hole 221 and is completely separated from the through hole 221, the stop buckle 321 returns to an original state and resists against the lock catch 22 to lock and fix the fixed plate 1 with the water baffle plate 2. Specifically, there are two stop buckles 321. Further, the stop buckle 321 is composed of a retaining block 3211 arranged on an outer wall of the locking strip 323 in a surrounding manner; and a minimum width of the retaining block 3211 is greater than a diameter of the through hole 221. Through the above structure, when the stop buckle 321 resists against the lock catch 22, the water baffle plate 2 is no longer rotated outwards under the stop action, thereby playing a fixing and locking role, so that the water baffle plate 2 is supported relative to the fixed plate 1, which effectively achieves the water blocking effect.

In this embodiment, the fixed plate 1 and the water baffle plate 2 are at least partially made of a flexible material. Specifically, the fixed plate 1 and the water baffle plate are made of a silica gel material. Through the above structure, since the fixed plate 1 and the water baffle plate 2 are made of the flexible silica gel material which usually has good deformation resistance, even under a pressure or distortion, the fixed plate and the water baffle plate can also maintain their shapes, the water baffle plate is less prone to deformation during use. This helps to maintain the performance stability and prevents deformation and damage due to excessive water flow impact during water splashing prevention performed by the user. Further, the silica gel material has high chemical corrosion resistance, which can resist some common corrosion factors, such as chemicals in water. This is conducive to maintaining the stability of the water blocking member during use and prolonging the service life of the water blocking member. The silica gel material has a smooth surface and an anti-sticking characteristic, making it convenient for the user to clean dirt and improving the user experience.

Further, at least one of the lock catch 22 and the locking member 32 is a flexible material component. Specifically, the lock catch 22 or the locking member 32 is a silica gel material component. Through the above structure, since the silica gel material has good elasticity and can quickly restore its original shape after an external pressure is applied. Therefore, the locking strip 323 can penetrate into the through hole 221 under the elastic pressing action, and press against an inner wall of the through hole 221 after restoring its original shape, thus achieving tight fixation. Therefore, connection and fixing between the lock catch and the locking member are achieved. Further, a silica gel surface usually has a certain degree of stickiness, which further enhances the fastening effect between two components.

In this embodiment, an elastic connecting section 7 is arranged between the water baffle plate 2 and the fixed plate 1, and the clastic connecting section 7 is configured to elastically connect the water baffle plate 2 to the fixed plate 1. Through the above structure, when the water baffle plate 2 is bent upwards, the clastic connecting section 7 will bend, so that the water baffle plate 2 can be lifted flexibly and smoothly, which improves the convenience of operation.

In this embodiment, one end of the fixed plate 1 away from the water baffle plate 2 is bent downwards to form a limiting part 3. An inner side surface of the limiting part 3 can resist against a front end surface of a water trough. Specifically, the limiting part 3 is a limiting plate connected to a side edge of the water baffle plate 2. The limiting plate plays a role in stabilizing the water blocking member, which is conductive to preventing the water blocking member from falling off.

In this embodiment, a bottom of the fixed plate 1 is connected to a fastening device 40, and the fixed plate 1 can be configured to be fixedly connected to a water trough surface through the fastening device 40. Specifically, the fastening device 40 includes at least one suction cup 9 mounted on a bottom surface of the fixed plate 1.

Further, the fastening device 40 includes at least one column of several suction cups 9 uniformly mounted on a bottom of the fixed plate 1. In this embodiment, two columns of uniformly arranged suction cups 9 are arranged at the bottom of the fixed plate 1. Through the above structure, the suction cups can be firmly adhered to a flat surface through the suction effect, so that the fixed plate can be stably fixed at a target position and is not easily moved or loosened by an external force. Compared to a traditional mounting method such as using a screw and glue, this method is more convenient, will not damage the surface, and is more suitable for being used in daily life.

In this embodiment, two sides of the fixed plate 1 protrude out to form insertion parts 8. The insertion parts can be configured to be inserted and connected to side baffle plates in another embodiment, so that the water baffle plate 2 and the side baffle plates are combined to form a water blocking region of a "U"-shaped structure. This further enhances the water blocking function and improves an acting force of the product.

Second Embodiment

Figure 7:
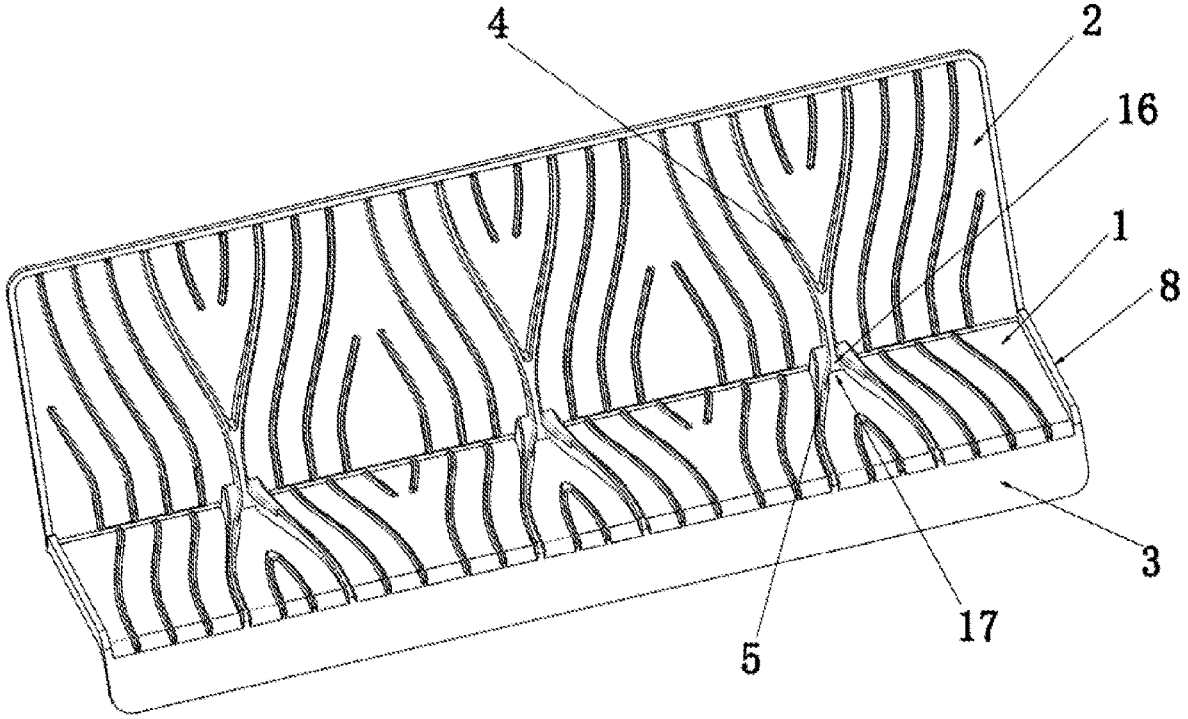
FIG. 7 is a schematic structural diagram of a second embodiment of the present disclosure.
Figure 8:
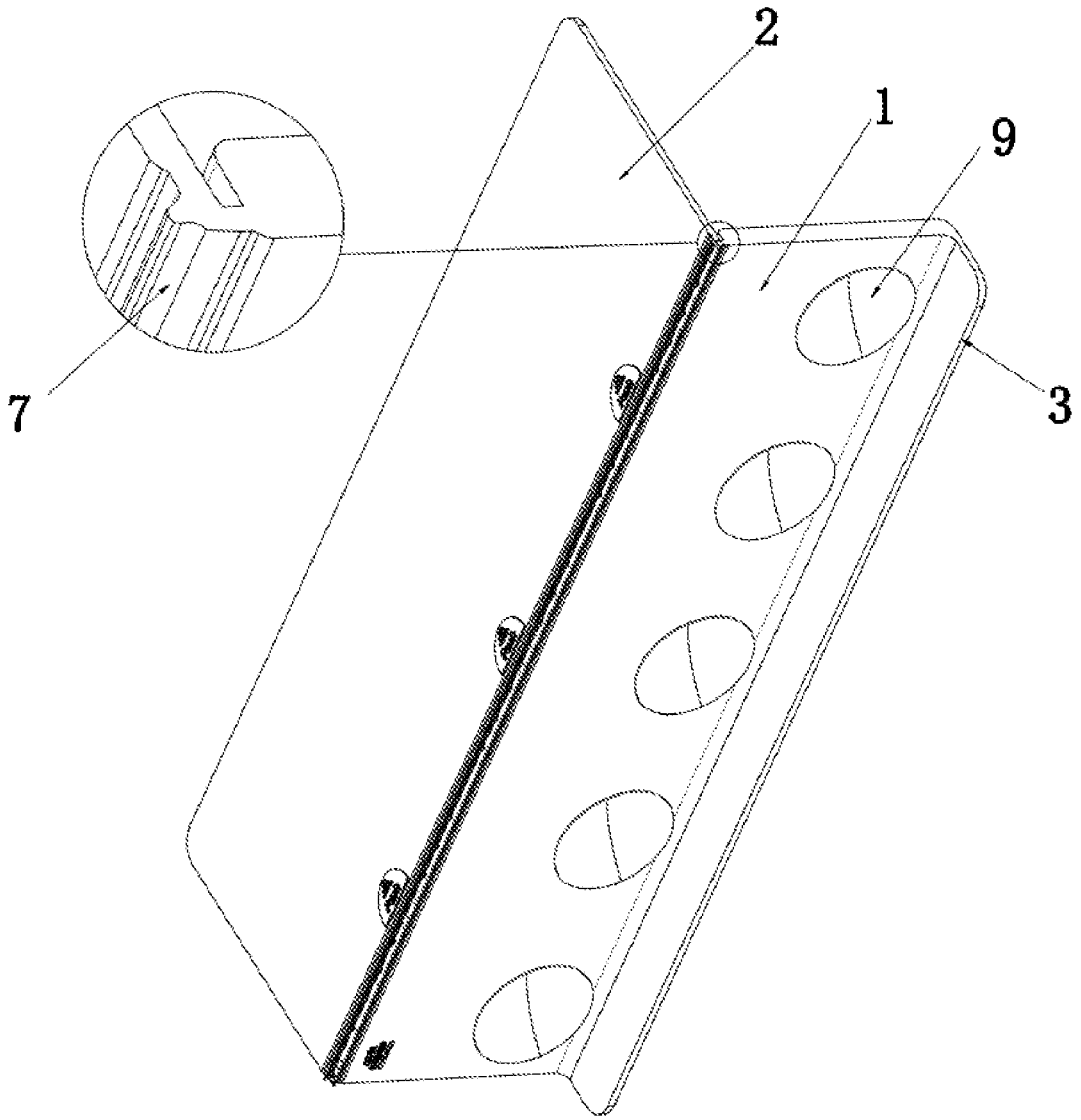
FIG. 8 is a bottom view of a second embodiment of the present disclosure.

As shown in FIG. 7 and FIG. 8, a water blocking member includes a fixed plate 1 and a water baffle plate 2. An outer surface of the water baffle plate 2 protrudes out to form a plurality of groups of snap-in members 21. An outer surface of the fixed plate 1 protrudes out to form a plurality of groups of clamping members 31 configured to clamp and fix the snap-in members 21.

In this embodiment, each snap-in member 21 is composed of one or more first reinforcing ribs 4; one ends of the first reinforcing ribs 4 extend inwards until the ends are connected and combined to form a snap-in part 16; each clamping member 31 is composed of one or more second reinforcing ribs 5; one ends of the second reinforcing ribs 5 extend inwards to form a clamping groove 17; and the snap-in parts 16 are all inserted into the clamping grooves 17 and are pressed and clamped inwards by the clamping grooves 17 to be fixed. The snap-in parts and the clamping grooves are formed by combining the first reinforcing ribs or the second reinforcing ribs on the outer surface of the water baffle plate, which can achieve a function of improving the firmness of the water baffle plate and the firmness of the fixed plate and has a snap-in function. This improves the practicability.

In this embodiment, a plurality of suction cups 9 are mounted on a bottom surface of the fixed plate 1, and the fixed plate can be sucked and fixed in front of a water trough through the suction cups.

In this embodiment, two sides of an opening above each clamping groove 17 are provided with flow guide parts. of arc-shaped structures. When the snap-in parts need to enter the clamping grooves, arc-shaped flow guide surfaces of the flow guide parts facilitate the snap-in parts to enter the clamping grooves.

In this embodiment, an elastic connecting section 7 is arranged between the water baffle plate 2 and the fixed plate 1. When the water baffle plate is bent upwards, the elastic connecting section will bend, so that the water baffle plate can be smoothly lifted.

In this embodiment, one end of each first reinforcing rib 4 away from each snap-in part 16 and one end of the second reinforcing rib 5 away from each clamping groove 17 are outwards opened in a "herringbone" manner. The first reinforcing rib 4 is thicker if it is closer to the snap-in part 16, and the second reinforcing rib 5 is thicker if it is closer to the clamping groove 17. This increases the thickness of a junction between the snap-in part and the clamping groove, so as to improve the firmness and service lives of the snap-in part and the clamping groove.

In this embodiment, one end of the fixed plate 1 away from the water baffle plate 2 is bent downwards to form a limiting part 3. An inner side surface of the limiting part can resist against a front end surface of a water trough.

During use, the water baffle plate can be lifted upwards. When the water baffle plate is lifted to a certain degree, the snap-in part on the outer surface of the water baffle plate may press a flow guide part at the opening of the clamping groove, to gradually open the clamping groove. After the water baffle plate is fully lifted, the entire snap-in part can be inserted into the clamping groove. Since the second reinforcing rib has an inward compression force after being opened under a pressure, the inserted snap-in part can be firmly clamped and fixed, to ensure the stability of the lifted water baffle plate. The lifted water baffle plate can effectively block splashing water ahead.

Third Embodiment

Figure 9:
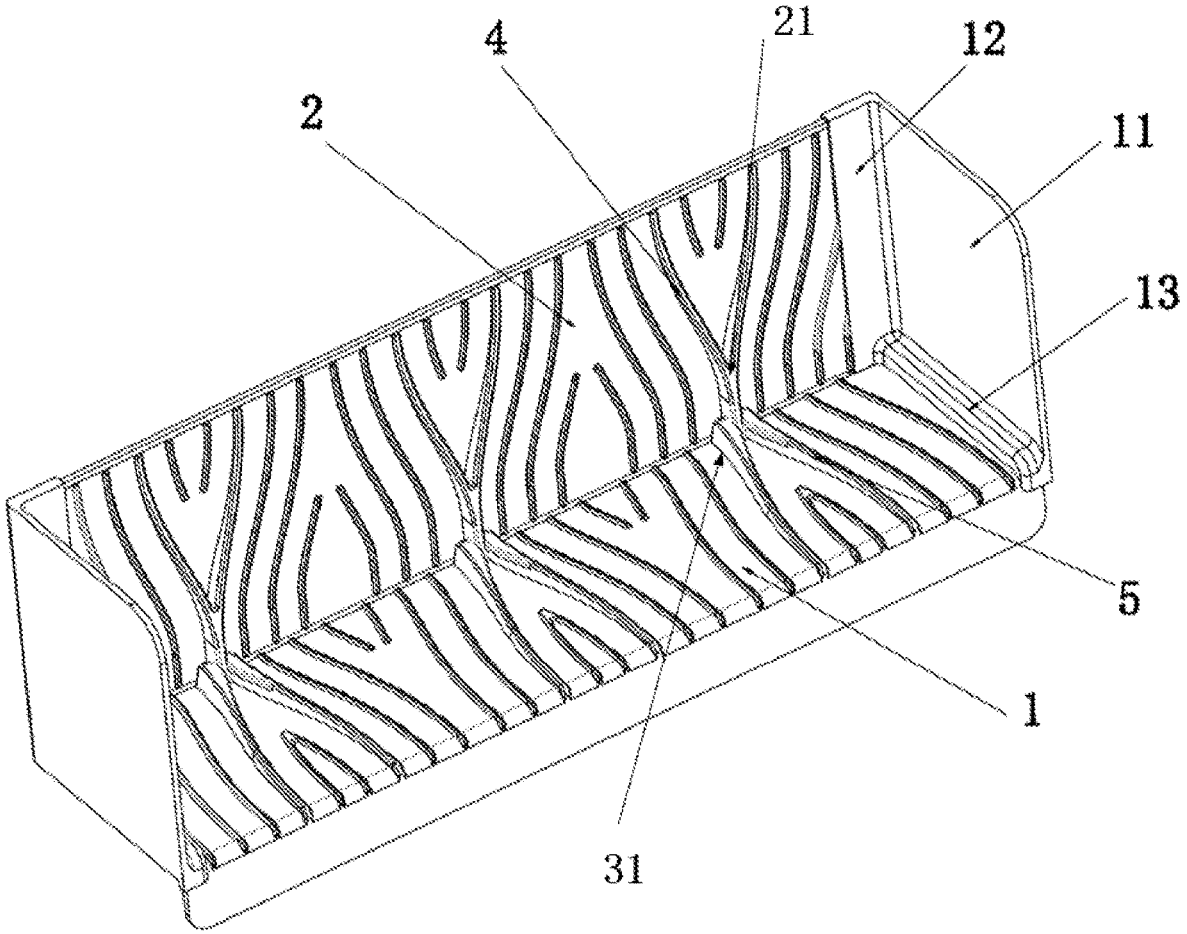
FIG. 9 is a schematic structural diagram of a third embodiment of the present disclosure.
Figure 10:
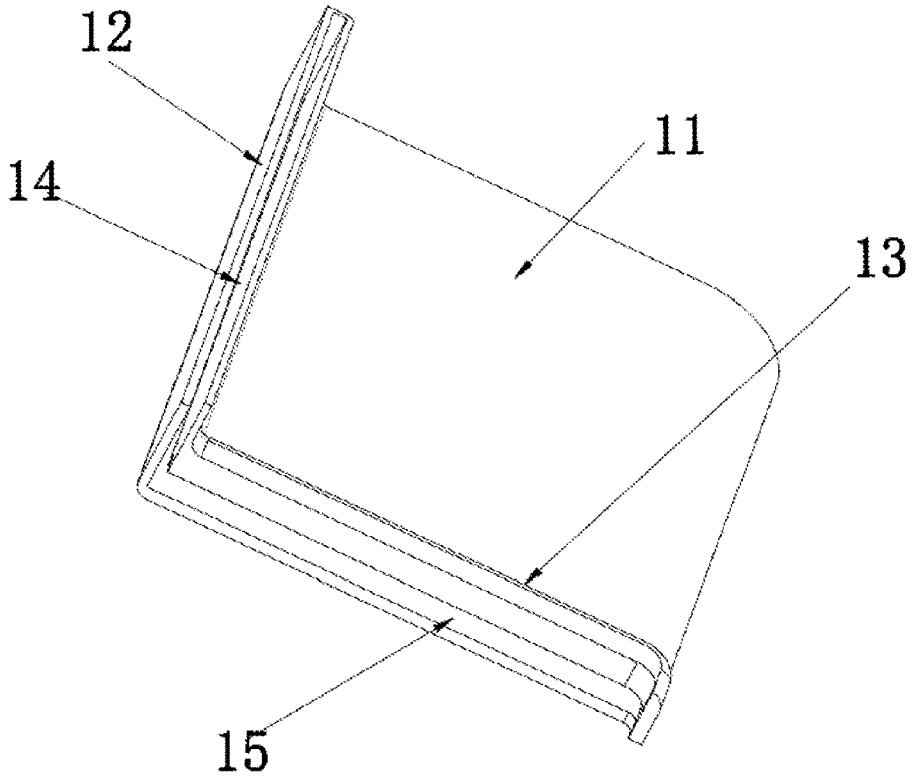
FIG. 10 is a schematic structural diagram of a side baffle plate according to the present disclosure.

As shown in FIG. 9 and FIG. 10, a water blocking member includes a fixed plate 1, a water baffle plate 2, and a plurality of side baffle plates. An outer surface of the water baffle plate 2 protrudes out to form a plurality of groups of snap-in members 21, and an outer surface of the fixed plate 1 protrudes out to form a plurality of groups of clamping members 31 configured to clamp and fix the snap-in members 21. One end of the fixed plate 1 away from the water baffle plate 2 is bent downwards to form a limiting part 3, and two ends of the fixed plate 1 are inserted into the side baffle plate 11.

Bottom surfaces of the side baffle plates 11 protrude out to form bases 13; one side surface of each side baffle plate 11 is provided with a connecting seat 12; the connecting seats 12 and the bases 13 are integrally connected; bottom surfaces of the bases 13 are provided with insertion grooves 15; connecting grooves 14 are formed in opposite surfaces of the connecting seats 12; the side baffle plates 11 are arranged on two sides of the fixed plate 1; the two sides of the fixed plate protrude out to form insertion parts 8; lower parts of the side baffle plates 11 sleeve the insertion parts 8 through the insertion grooves 15; one sides of the side baffle plates 11 sleeve two ends of the water baffle plate 2 through the connecting grooves 14; and the water baffle plate 2 and the side baffle plates 11 are combined to form a water blocking region of a "U"-shaped structure.

In order to enlarge a water blocking range, after the water baffle plate is lifted, two side baffles can be removed. The lower parts of the side baffles sleeve the insertable side baffle plates of the fixed plate through the insertion grooves on the bases. The connecting seats on one sides of the side baffle plates sleeve the two ends of the water baffle plate through the connecting grooves, so that a whole structure can be formed by connection. The water blocking function of the side surfaces can be further enhanced through the side baffle plates, and the applicability is improved.

Figure 11:
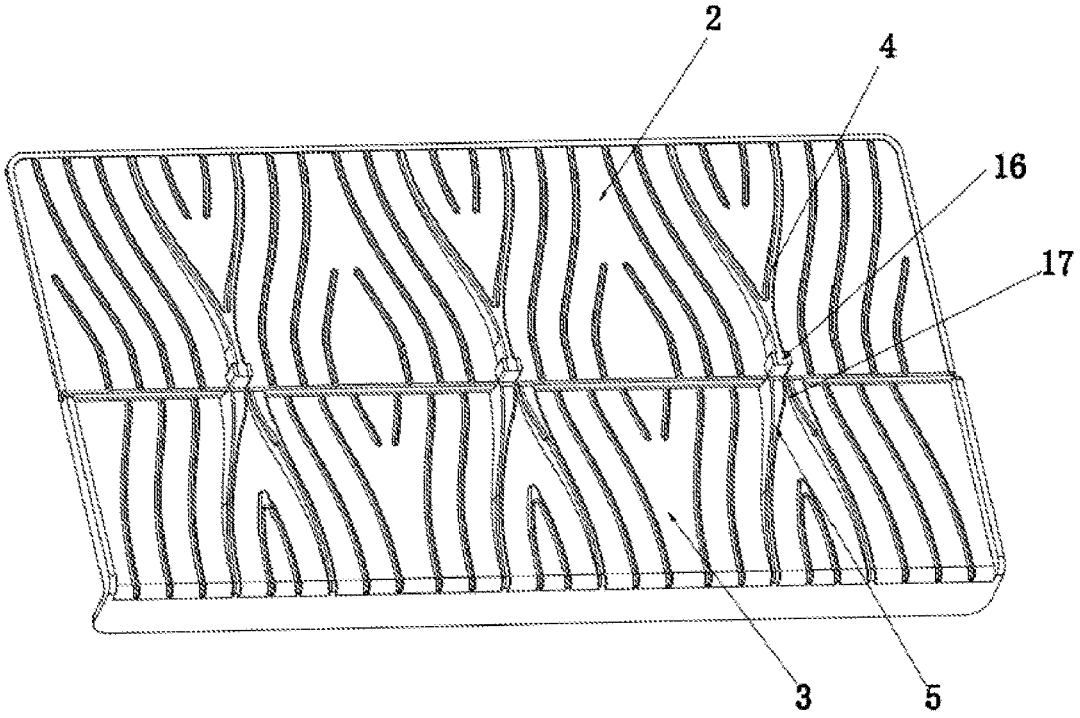
FIG. 11 is a schematic structural diagram when a water baffle plate is not used according to the present disclosure.

As shown in FIG. 11, when the water blocking member is not used, the side baffle plates can be removed and the water baffle plate can be pressed. The rotation of the water baffle plate synchronously drives the snap-in parts, so that the snap-in parts are separated from the clamping grooves until the water baffle plate is horizontally placed in front of a water trough, which reduces the height and facilitates cleaning.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A water blocking member, comprising:

a fixed plate;

a water baffle plate, wherein the fixed plate is rotatably connected to the water baffle plate; and a locking device, wherein the water baffle plate and the fixed plate are locked and fixed through the locking device, and the locking device is configured to lock an angle between the water baffle plate and the fixed plate;

wherein the locking device comprises a first connector and a second connector; the first connector is arranged on the water baffle plate; the second connector is arranged on the fixed plate;

and the first connector is connected to the second connector to lock and fix the fixed plate with the water baffle plate.

2. The water blocking member according to claim 1, wherein the locking device is a strap locking device, a hook and loop fastener locking device, a snap ring locking device, an elastic band locking device, or a suction locking device.

3. The water blocking member according to claim 2, wherein the suction locking device comprises a magnetic suction locking device or a suction cup locking device.

4. The water blocking member according to claim 1, wherein the first connector is detachably connected to the second connector.

5. The water blocking member according to claim 4, wherein the first connector comprises at least one lock catch, and the second connector at least comprises one locking member; each lock catch is provided with a through hole; and the locking member passes through the through hole and is compressed and locked to the lock catch.

6. The water blocking member according to claim 5, wherein the locking member is provided with at least one stop buckle; the locking member and the stop buckle pass through the through hole by compression; and when each stop buckle is pressed into the through hole and is completely separated from the through hole, the stop buckle returns to an original state and resists against the lock catch to lock and fix the fixed plate with the water baffle plate.

7. The water blocking member according to claim 6, wherein the lock catch is composed of a bulge arranged on the fixed plate; the locking member comprises a third reinforcing rib arranged on the water baffle plate and a locking strip fixedly connected to the third reinforcing rib; and a maximum width of the locking strip is slightly greater than a diameter of the through hole, so that when passing through the through hole, the locking strip is locked and fixed with the bulge under the pressing action.

8. The water blocking member according to claim 7, wherein the stop buckle is composed of a retaining block arranged on an outer wall of the locking strip in a surrounding manner; and a minimum width of the retaining block is greater than a diameter of the through hole.

9. The water blocking member according to claim 4, wherein the first connector comprises at least one clamping member; an outer surface of the water baffle plate protrudes out to form the clamping member; the second connector comprises at least one clamping member; and an outer surface of the fixed plate protrudes out to form the clamping member configured to clamp and fix the clamping member.

10. The water blocking member according to claim 9, wherein each clamping member is composed of one or more first reinforcing ribs; one ends of the first reinforcing ribs extend inwards until the ends are connected and combined to form a clamping part; each clamping member is composed of one or more second reinforcing ribs; one ends of the second reinforcing ribs extend inwards to form a clamping groove; and the clamping parts are all inserted into the clamping grooves and are pressed and clamped inwards by the clamping grooves to be fixed.

11. The water blocking member according to claim 9, further comprising side baffle plates, wherein the side baffle plates are inserted into two ends of the fixed plate.

12. The water blocking member according to claim 11, wherein bottom surfaces of the side baffle plates protrude out to form bases; one side surface of each side baffle plate is provided with a connecting seat; the connecting seats and the bases are integrally connected; bottom surfaces of the bases are provided with insertion grooves; connecting grooves are formed in opposite surfaces of the connecting seats; the side baffle plates are arranged on two sides of the fixed plate; the two sides of the fixed plate protrude out to form insertion parts; lower parts of the side baffle plates sleeve the insertion parts through the insertion grooves; one sides of the side baffle plates sleeve two ends of the water baffle plate through the connecting grooves; and the water baffle plate and the side baffle plates are combined to form a water blocking region of a "U"-shaped structure.

13. The water blocking member according to claim 1, wherein an elastic connecting section is arranged between the water baffle plate and the fixed plate, and the elastic connecting section is configured to elastically connect the water baffle plate to the fixed plate.

14. The water blocking member according to claim 1, wherein one end of the fixed plate away from the water baffle plate is bent downwards to form a limiting part.

15. The water blocking member according to claim 1, wherein a bottom of the fixed plate is connected to a fastening device, and the fixed plate is configured to be fixedly connected to a water trough surface through the fastening device.

16. The water blocking member according to claim 15, wherein the fastening device comprises at least one suction cup mounted on a bottom surface of the fixed plate.

17. The water blocking member according to claim 16, wherein the fastening device comprises at least one column of several suction cups uniformly mounted at the bottom of the fixed plate.

18. The water blocking member according to claim 1, wherein the fixed plate and the water baffle plate are at least partially made of a flexible material.

19. The water blocking member according to claim 5, wherein at least one of the lock catch and the locking member is a flexible material component.

* * * * *